US007607210B2

(12) United States Patent
Anagnostopoulos

(10) Patent No.: US 7,607,210 B2
(45) Date of Patent: Oct. 27, 2009

(54) METHOD AND MACHINE FOR THE PRODUCTION OF REINFORCEMENT AND DOWEL SIDE FRAMES FOR CONCRETE REINFORCEMENT FROM WIRE OR ROD OR OTHER MATERIAL OF PRISMATIC CROSS SECTION

(76) Inventor: Antonios Anagnostopoulos, Bitsi Street 1, Kifissia, Attikis (GR) GR-14562

( * ) Notice: Subject to any disclaimer, the term of this patent is extended or adjusted under 35 U.S.C. 154(b) by 819 days.

(21) Appl. No.: 10/467,933

(22) PCT Filed: Dec. 27, 2001

(86) PCT No.: PCT/GR01/00050

§ 371 (c)(1),
(2), (4) Date: May 12, 2004

(87) PCT Pub. No.: WO02/066179

PCT Pub. Date: Aug. 29, 2002

(65) Prior Publication Data

US 2004/0177489 A1 Sep. 16, 2004

(30) Foreign Application Priority Data

Feb. 22, 2001 (GR) ..... 010100096

(51) Int. Cl.
*B23P 11/00* (2006.01)
*B21D 47/00* (2006.01)

(52) U.S. Cl. ..... 29/525.14; 29/897.312

(58) Field of Classification Search ..... 29/525.14, 29/527.1, 897.312, 417, 425, 34 D, 897.3, 29/897, 34 R, 33 R, 33.5, 561, 563, 565, 29/566.1, 33 F, 771, 779, 791, 281.5
See application file for complete search history.

(56) References Cited

U.S. PATENT DOCUMENTS 4,291,732 A 9/1981 Artzer (Continued)

FOREIGN PATENT DOCUMENTS

EP 0355776 B1 5/1995

(Continued)

*Primary Examiner*—John C Hong
(74) *Attorney, Agent, or Firm*—George Kapsalas; Patentbuero Paul Rosenich AG

(57) ABSTRACT

According to the method, the transversal wire or rebar to be formed (1) and the longitudinal wires or rebars or other material of prismatic cross section (2), (3) are fed to the main forming and welding machine subsystem, in a stepwise manner, at the appropriate distance each time, through a driving mechanism (22-30). At this location, the transversal wire (1) is cut and then formed upon the action of a press (36). Welding of the formed transversal frame with one of the two longitudinal wires is performed while the formed transversal wire is still restrained by the action of the press (38) at the formation location. Welding with the second longitudinal wire is performed at the next production step, simultaneously with the welding of the next transversal frame with the first longitudinal wire, at the formation location. After the welding action, the transversal frame is released by the press and the forming tools (37-39), and the next production step is initiated. The product is made in a continuous shape and is cut at the proper lengths, by a cutter (45).

21 Claims, 12 Drawing Sheets

U.S. PATENT DOCUMENTS

| | | | |
|---|---|---|---|
| 4,500,763 | A | 2/1985 | Schmidt et al. |
| 4,526,025 | A | 7/1985 | Ritter et al. |
| 5,446,254 | A | 8/1995 | Ritter et al. |

FOREIGN PATENT DOCUMENTS

| | | | |
|---|---|---|---|
| FR | 2246327 | | 5/1975 |
| FR | 2397895 | | 2/1979 |
| JP | 05-076974 | A | 3/1993 |

SECTION A–A'

SECTION B–B'

SECTION E–E'

SECTION Z–Z'

SECTION E–E'

SECTION Z–Z'

SIDE VIEW

TOP VIEW

METHOD AND MACHINE FOR THE PRODUCTION OF REINFORCEMENT AND DOWEL SIDE FRAMES FOR CONCRETE REINFORCEMENT FROM WIRE OR ROD OR OTHER MATERIAL OF PRISMATIC CROSS SECTION

This application is a 371 national-phase entry of PCT International application No. PCT/GR01/00050 filed on Dec. 27, 2001, the entirety of which is incorporated herein by reference for all intents and purposes as if fully set forth herein, and which claims foreign priority benefit of Greek national application No. 20010100096 filed on Feb. 22, 2001.

BACKGROUND OF THE INVENTION

The present invention refers to a method and a machine for the production of reinforcement and Dowel side frames for concrete, from wire or rod or other material of prismatic cross section.

In order to assist in understanding the field of the invention, several representative products that may be delivered by the machine, according to the present invention, are presented in FIGS. 1A-1D. As shown there, the products are characterized by two parallel wire rods and by appropriately formed wire frames, which are welded transversely on specific points on the two parallel wires, in order to create a uniform and rigid at one direction side frame. The transversal wire frames may maintain the same geometry FIG. 1A, FIG. 1B or may vary, by alternating frames of two different geometries FIG. 1C. The product may be characterized by the distance of the two longitudinal wires (b1), by the step of the transversal frame (a1), by the distance of two consecutive transversal frames, measured on the points where their sides meet the longitudinal wires (a2), and the lengths of the transversal wire sides (b2). In the case of alternating transversal frames of two different geometries, the product may be characterized further by the proportion of wire length on each side of the transversal frame with respect to the formation axis (b3).

These products are typically used as reinforcement for concrete as well as in the composition of beams, columns and other construction made of reinforced concrete FIG. 1D. They may also be employed in the construction of buildings, roads and bridges, as well as in support beams for the manufacturing of metal constructions and metal shelters.

The referenced product is manufactured mainly semi-automatically. The transversal parts of the product are manufactured by a bending machine or by a press. The already formed pieces are transferred and placed on the longitudinal wires at specific locations, where they are welded either through electrodes (resistance welding) or through soldering. The disadvantages of the semi-automated manufacturing mode are the difficulty in maintaining the proper product geometry, the not-very consistent welding quality, and the high production cost.

The automated manufacturing was typically achieved with the following two methods. In the first method, the transversal wire frame is formed at an automatic bending machine and then it is transferred, through a robotic system, at the proper location, where it is welded with electrodes (resistance welding). In the second method, the transversal frame is manufactured by a press, and then, through a transfer mechanism, it is placed at the proper location, where it is welded with resistance welding.

The transfer mechanism of the already formed transversal frame constitutes the main disadvantage of the automated production methods, since the transfer mechanism makes the overall machine operation very complicated and expensive. Furthermore, the wire undergoes elastic deformation (recuperation), resulting in changes in the final product geometry and various inaccuracies during the transverse frame transfer.

BRIEF SUMMARY OF THE INVENTION

Accordingly, it is an object of the present invention to present a method, which will overcome all the disadvantages of the existing methods and machines and which will lead to the manufacture of a machine, that will allow the fully automated manufacturing of the product, at a consistently high quality, and with flexibility in the manufacturing of a variety of products, i.e. leading to faster and simpler production of higher-quality products.

It is a further object of this invention to supply a machine, which automates the production of frames for concrete reinforcement, maximizes the machine flexibility and minimizes time for the machine adjustments (down time), produces excellent-quality product, where at the same time, it maintains simple design, reliable operation, user friendliness and high product capacity.

As a further object, the present invention supplies a method for the manufacturing of Dowel-type reinforcement, for example such as those depicted in FIGS. 1A-1D, of various geometries, made of wire or rebar, tube or prismatic beam of arbitrary cross section, where the transversal frames of the reinforcement can be either of constant geometry or consisting of plural different alternating geometrical shapes, and where the distance between each transversal frame may be constant or variable.

It is yet a further object of the present invention to provide a method and machine for the production of the transversal frames with the aid of a forming mold and forming tools that may be quickly and simply changed. Also according to the machine and method, the welding of the formed transversal wire with at least one of the two longitudinal wires at the formation location may be effected without the need for a mechanism for the transfer of the formed transversal wire from its formation location to some other location for welding. Accordingly, a high-quality final product may be obtained since the welding of the formed transversal wires may occur simultaneously with their formation, thus preserving their shape without allowing deformations due to elastic recuperation. Thus, the machine and method may also lend themselves to the production of a variety of shapes of transversal wire frames, which are welded to at least one longitudinal wire at the formation location. As a further advantage, the transversal wires need not be protruding from the second longitudinal wire. Furthermore, the product step may be easily changed since it only relates to the change of the length of the advancement of the wires and the location of the welding devices. In summary, the invention provides a simple implementation and simple procedures.

More details about the method and the machine, according to the present invention, will be understood, after the description of the following implementations of the invention. The machine is described in the attached schemes, in the sense of a non-restrictive example. These and other features, aspects, and advantages of the present invention will become better understood with regard to the following description, appended claims, and accompanying drawings, where:

DETAILED DESCRIPTION

Figure 2:
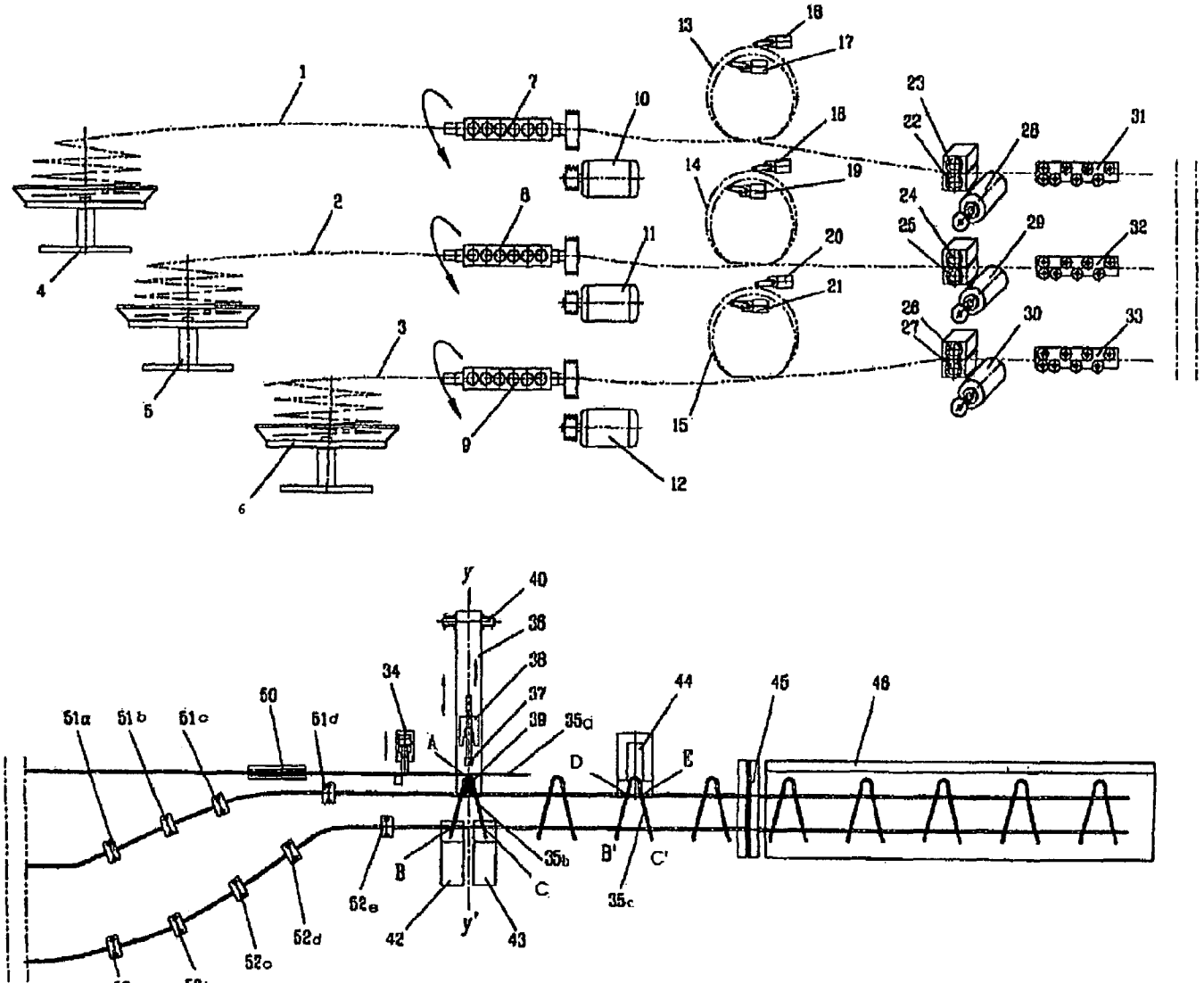
FIG. 2 schematically shows in partial views a version of a machine according to the invention and by which a version of the method of the invention may be effected.

As depicted beginning in FIG. 2, three pay-off stations (4), (5) and (6) feed the wires (1), (2) and (3) into the machine. To explain terminology used throughout the remainder of the detailed description and appended claims, the following definition of terms is clarified: For simplicity and ease of reference thereto, the terms "wire," "wire rods," "rods," "tubes," and "material of prismatic cross-section" are used interchangeably and equivalently throughout the remainder of the detailed description and appended claims. Thus artisans in the art will readily understand that the term "rods" within the appended claims encompasses and includes the aforesaid "wire," "tubes," and generally "material of prismatic cross-section" without differentiation unless such differentiation is explicitly set forth. Any utilizable materials of prismatic cross-section may be conveniently and clearly referred to in non-limiting, simplified brief form by the terms "rods," or "wires." The three wires are straightened at three straightening devices (7), (8) and (9), which are driven by three motors (10), (11) and (12) respectively, and then they are forwarded to the wire buffers (13); (14) and (15) respectively. The quantity of the wire stored in each buffer is controlled by two terminal switches for each wire, which determine the minimum and maximum wire quantity stored in each buffer, and which control the start and stop operation of the motors (10), (11) and (12) respectively.

The wires (1), (2) and (3) are fed to the main transversal wire-formation mechanism through pairs of feeding rollers (22) and (23), (24) and (25), (26) and (27), driven by the motors (28), (29) and (30) respectively, after they are straightened again at the devices (31), (32) and (33), so that the slight deformation that they underwent in the buffers is eliminated. During feeding of the wires to the main mechanism, wire (1) is maintained fixed on a straight line through guide (50) as shown, whereas wires (2) and (3) converge through guides (51*a*)-(51*d*) and (52*a*)-(52*e*), respectively, to the appropriate distances required for each specific product, so that they can undergo the appropriate formations from the respective mechanisms, in the process of manufacturing the final product. The convergence of wires (2) and (3) is obtained at a suitable length, so that wires (2) and (3) do not undergo plastic deformation.

Figure 3A:
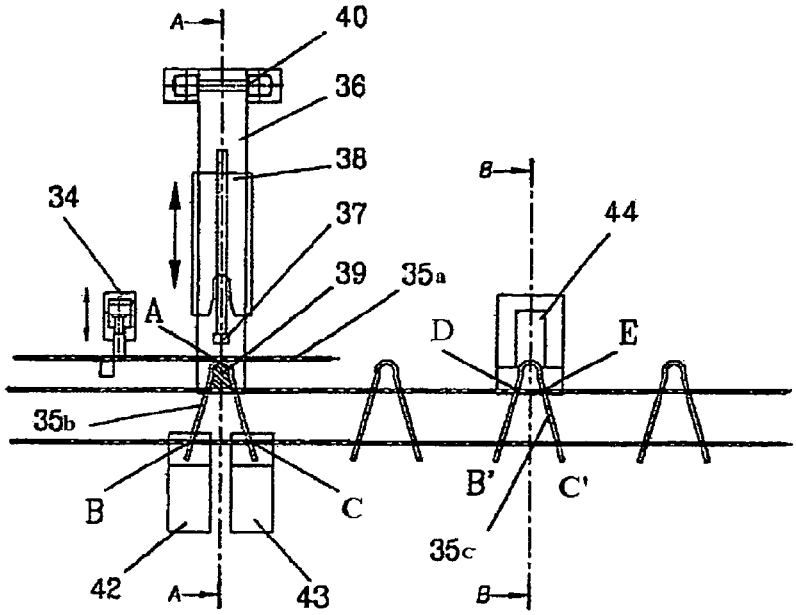
FIG. 3A is a plan view depicting a version of the invention including formation and welding assemblies.
Figure 3B:
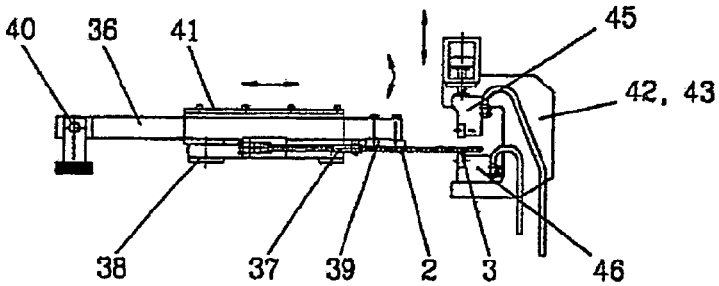
FIG. 3B is a side elevational view taken along a side parallel to axis AA' of FIG. 3A.
Figure 3C:
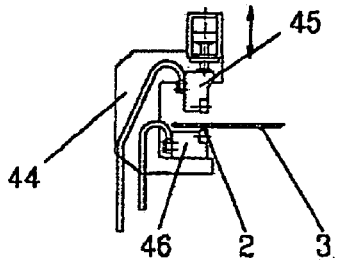
FIG. 3C is a side elevational view taken along a side parallel to axis BB' of FIG. 3A.

According to a version of the machine shown in FIGS. 3A-3C, two formation tools (38) and (39) and one restrainer (37) are utilized for the formation of the transversal wires, one wire cutter (34) is utilized for cutting of the transversal wire at the proper length, and three welding devices (42), (43) and (44) are utilized for the welding of the formed transversal wire pieces with the longitudinal wires (2) and (3). The wire formation tool (39) is nearly in contact with the wire to be formed (35*a*), whereas the formation tool (38) moves perpendicularly to the wire to be formed (35*a*), so that with the aid of tool (39) it provides the required formation. The restrainer of the wire (35*a*) moves perpendicularly to the wire to be formed (35*a*), it presses it on tool (39), and holds it during the cutting and formation process. The forming tools (38) and (39) and the restrainer (37) are able to move perpendicularly to the plane defined by the formed wires, where all cutting and forming processes of the transversal frames occur. Through this movement, the formation tools along with the restrainer can move towards the formation plane, so that the wire (35*a*) is formed to the shape (35*b*), and consequently, they move away from the formation plane and the formed wire (35*b*), so that the formed transversal frame can be advanced. In FIG. 3, and for the sake of better understanding of the present invention, in one implementation, the moving formation tools and the restrainer are supported on a beam (36), free at one end (the one near the formation tools) and simply supported and been able to rotate at the other (far) end.

The welding devices (42) and (43) are positioned one at each side of the axis of formation of the tools (38) and (39) and at the locations where the formed wire (35*b*) intersects the longitudinal wire (3), whereas the welding device (44) is positioned on the transversal wire (2), at a distance from the formation tools axis, preferably equal to an integral multiple of the product step.

The process for completion of one product step may proceed as better understood from FIGS. 3A-3C and FIGS. 4A-4F:

Wires (2) and (3) are fed into the formation mechanism, preferably at a length equal to one step of the complete final product, and wire (1) is fed at a length equal to the desired initial length of a transversal piece before formation occurs. The cutter (34) is placed at the appropriate location so that it can cut off the right length of the transversal wire to be formed.

Wire (1) is held firmly on the formation tool (39) by the restrainer (37) and it is cut off at the appropriate length by the cutter (34). The forming tool (38) moves towards the tool (39) and deforms the wire (35*a*) bringing it to the shape (35*b*). During the formation process, the two ends of the formed wire (35*b*) are transferred to points B and C, as shown in FIG. 3A, where the formed wire (35*b*) may be fastened with the longitudinal wire (3) at the welding devices (42) and (43) either through electrodes (resistance welding) or alternately through soldering, while the formed wire (35*b*) is firmly held by the restrainer (37) and is entrapped by both formation tools (38) and (39).

Following the above, restrainer (37) is released and the tool (38) moves away from the tool (39), so that the formed transversal wire, which is welded on the longitudinal wire (3), is no longer restrained. The formation tools (38), (39) and (37) move away from the formed transversal wire towards a direction perpendicular to the formation plane, so that the formed transversal wire is released and can be advanced away from the formation mechanism.

After the formed wire frame (35*b*) is released from the formation tools it advances by one product step, carried by the wires (2) and (3), which advance at a length equal to one product step. At the same time, wire (1) advances at a length equal to the initial length of a desired transversal piece. The formed wire (35*b*) moves to the location (35*c*), where it is welded at points D and E, by the welding device (44). Welding at points D and E takes place simultaneously with the formation of the next transversal wire frame (35*b*) on the formation mechanism by the tools (38) and (39).

As shown in FIG. 2, the step-by-step manufactured product may be transferred to a storage unit (46), through cutter (45). When the required length of product is achieved, the cutter (45) is activated, and the product is delivered to the storage unit (46).

Figure 4A:
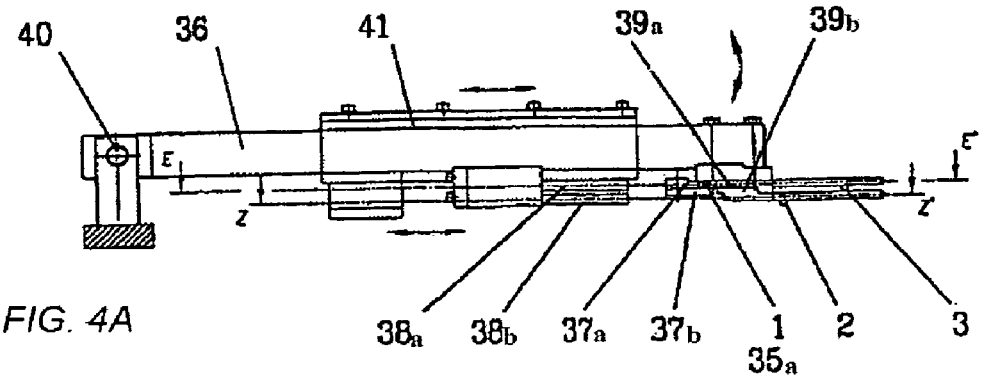
FIG. 4A is an elevational view depicting a version of a main formation assembly including plural forming tools, by which a version of the method of the invention may be effected.
Figure 4B:
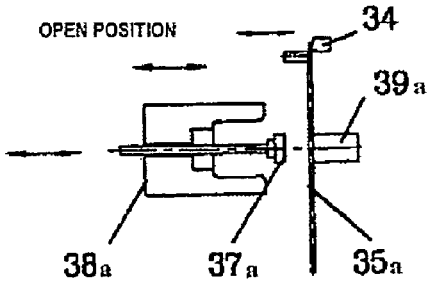
FIG. 4B and FIG. 4C are related enlarged sectional portion views of a first set of formation tools and restrainer taken along axis EE' of FIG. 4A and depicting, respectively, the open and closed positions for the formation mechanism.
Figure 4C:
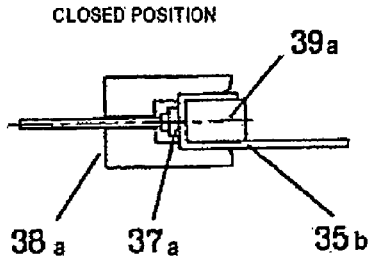
Figure 4D:
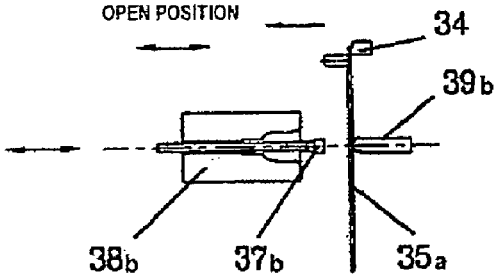
FIG. 4D and FIG. 4E are enlarged sectional portion views of a second set of formation tools and restrainer taken along axis ZZ' of FIG. 4A and depicting, respectively, the open and closed positions for the formation mechanism.
Figure 4E:
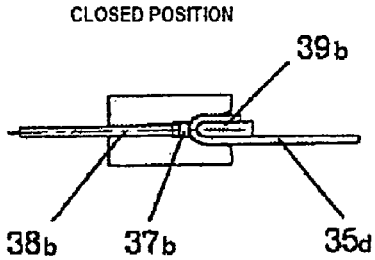
Figure 4F:
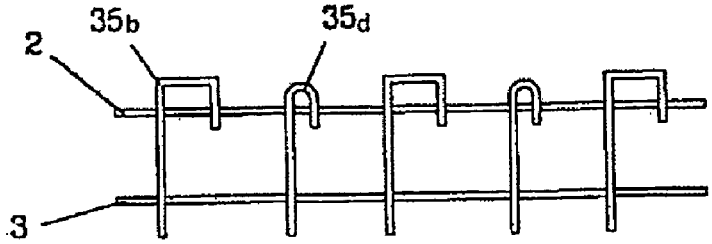
FIG. 4F schematically shows a representative product that may be produced by a version of the invention, for example as illustrated in FIGS. 4A-4E.

The transversal formed wires may all be the same, as described until now, or they may comprise plural alternating geometrical shapes, as shown in FIG. 4F.

In FIG. 4F, each transversal formed wire is produced by at least one pair of forming tools and restrainer. The transversal wire frame (35*b*) is produced by the tools (38*a*, 39*a*) and the restrainer (37*a*) (FIGS. 4B-4C), whereas the transversal wire frame (35*d*) by the tools (38*b*, 39*b*) and the restrainer (37*b*). The forming tools and restrainers may be properly placed one under the other as shown in FIG. 4A. The height (thickness) of the tools corresponds to the diameter of the wire to be formed.

The location of the wire to be formed (1) is maintained fixed in space, and able to move on a straight line. The forming tools and the restrainer can move at a direction normal to the formation plane EE' (FIG. 4A), so that the proper tools for each transversal wire frame are transferred to the formation plane EE'. In one implementation of the method (FIG. 4), the transfer of each set of formation tools and restrainer is implemented by rotation of the tools' supporting frame about a point far from the wire formation location. Thus, by rotating the beam (36) about axis (40), the respective forming tools and restrainer, which are shown at the cross sections EE' and ZZ' and detailed in FIGS. 4B-4E respectively, are transferred to the formation plane EE'.

The welding part is implemented in the same manner as in the case of transversal wires of only one geometrical shape, at the welding devices (42), (43) and (44), which are placed at the appropriate locations with respect to the formation axis.

In the case where two different shapes of transversal frames are formed, the cutter (34) is positionable, and is transferred to the appropriate each time location for each transversal wire.

In the case where the welding devices (42), (43) and (44) must act at different locations with respect to the formation axis each time, they are supported on suitable transfer mechanisms, which position them at the appropriate location for the welding action, each time.

Figure 1A:
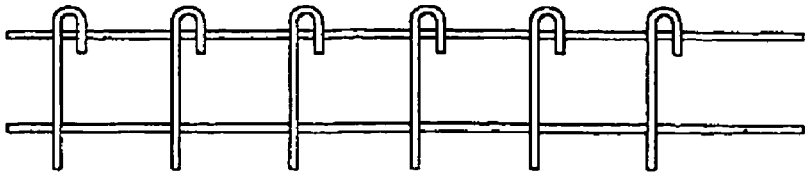
FIG. 1A PRIOR ART
FIG. 1A schematically shows a first product of a known type.
Figure 1B:
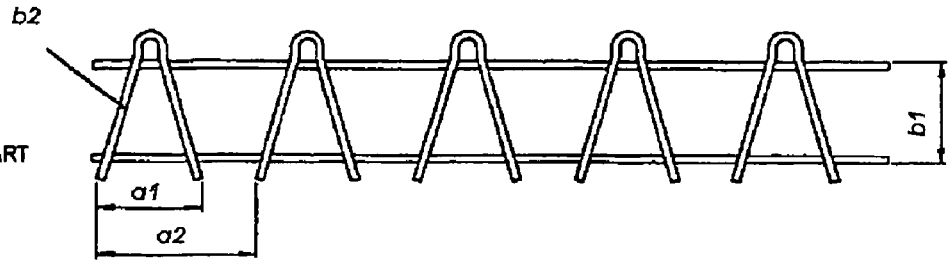
FIG. 1B PRIOR ART
FIG. 1B schematically shows a second product of a known type.
Figure 1C:
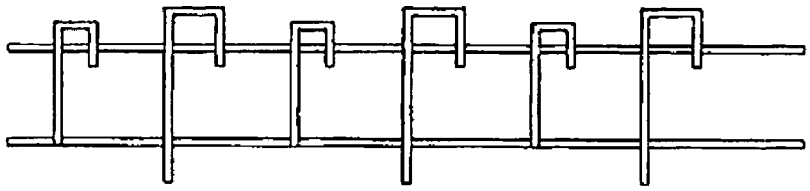
FIG. 1C PRIOR ART
FIG. 1C schematically shows a third product of a known type.
Figure 1D:
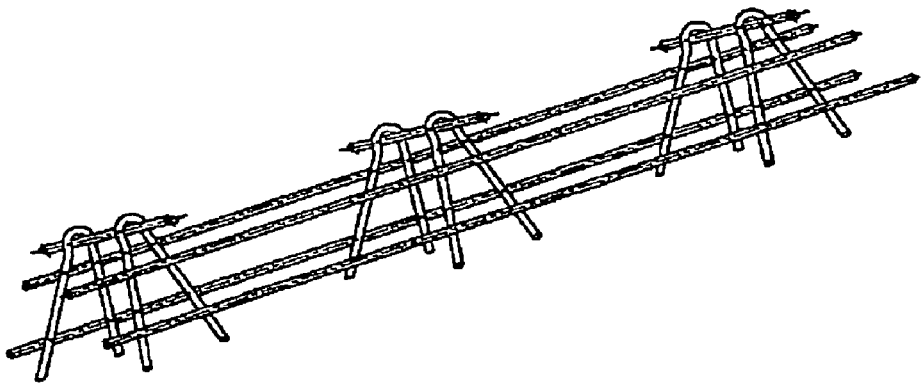
FIG. 1D PRIOR ART
FIG. 1D schematically shows a fourth product of a known type.

The ends of the transversal wire frames may be protruding beyond the second longitudinal wire, as shown in FIGS. 1A-1B and in half of the transversal frames of FIG. 1C or they may not be protruding beyond the second wire as in half of the transversal frames of FIG. 1C. Production of this arrangement is possible because the transversal frame is welded while it is restrained on the formation position.

A version of the formation machine and of the formation method is presented in FIG. 5A, FIG. 5B, FIG. 5C and FIG. 5D. For the sake of the example and without restricting the range of the method applications, the material to be formed (1) and the materials of the longitudinal wires (2) and (3) are considered wires of cylindrical cross section.

Figure 5A:
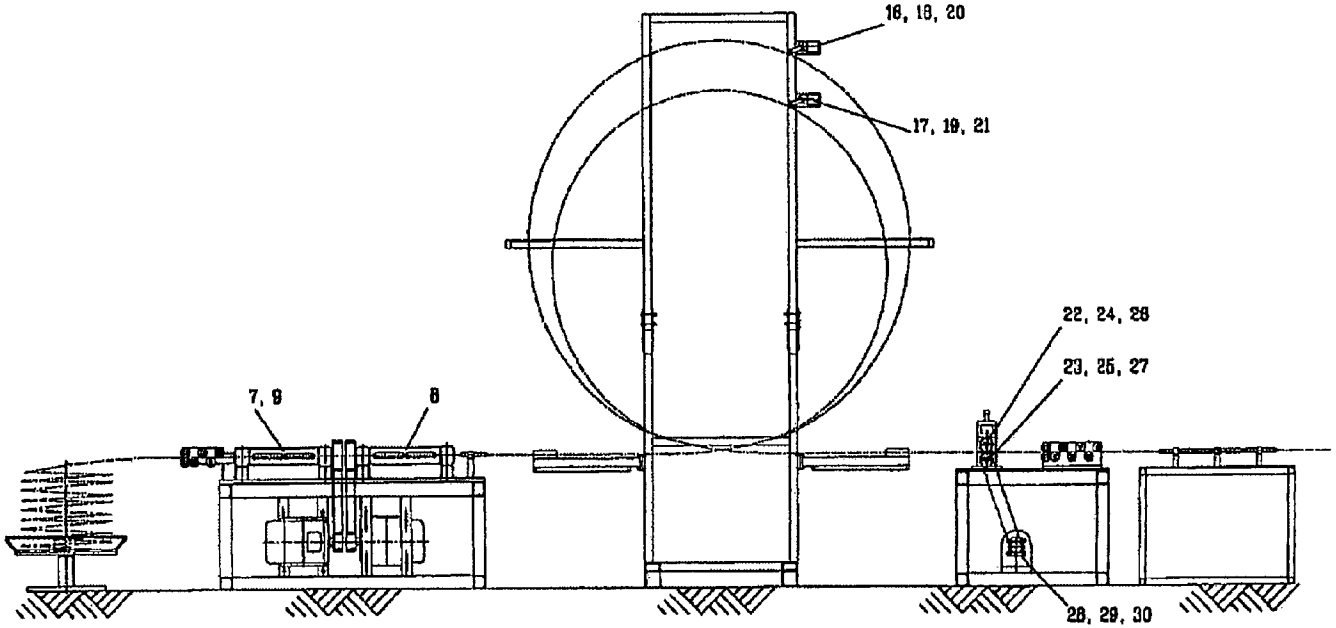
FIG. 5A shows a partial side elevation view of a version of the invention, and will be understood to join with the continuing view in FIG. 5C, to complete a view of apparatus by which a version of the method of the invention may be effected.
Figure 5B:
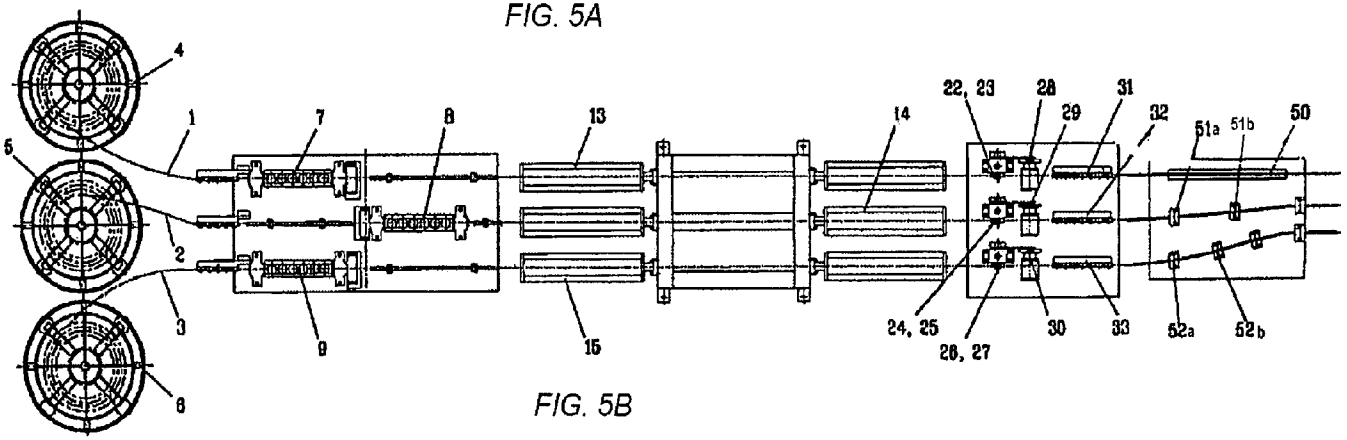
FIG. 5B shows a partial plan view of a version of the invention, and will be understood to join with the continuing view in FIG. 5D, to complete a view of apparatus by which a version of the method of the invention may be effected.
Figure 5C:
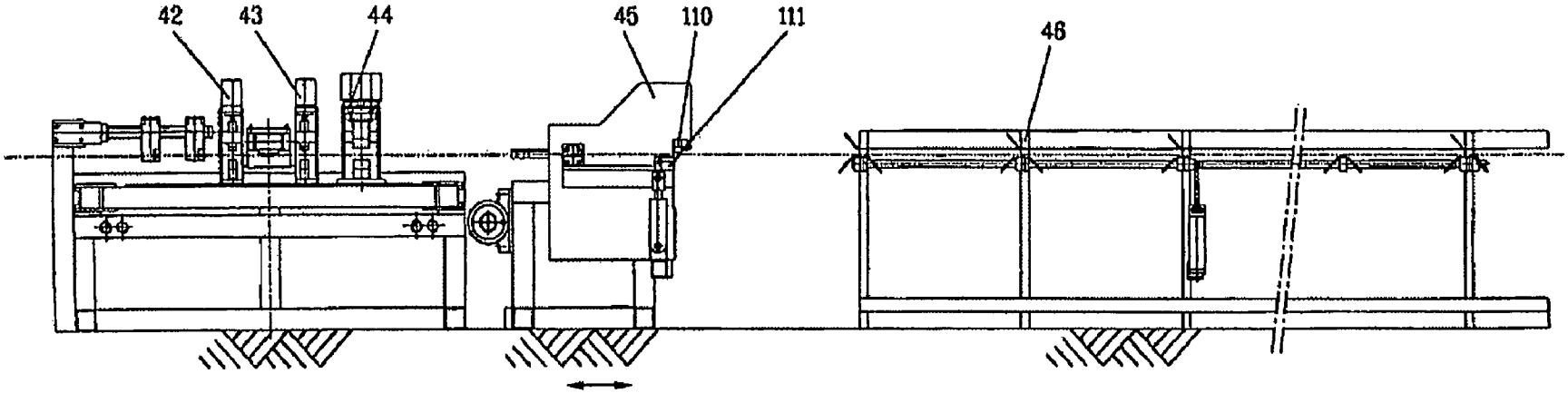
FIG. 5C continues the side elevational view shown in FIG. 5A.
Figure 5D:
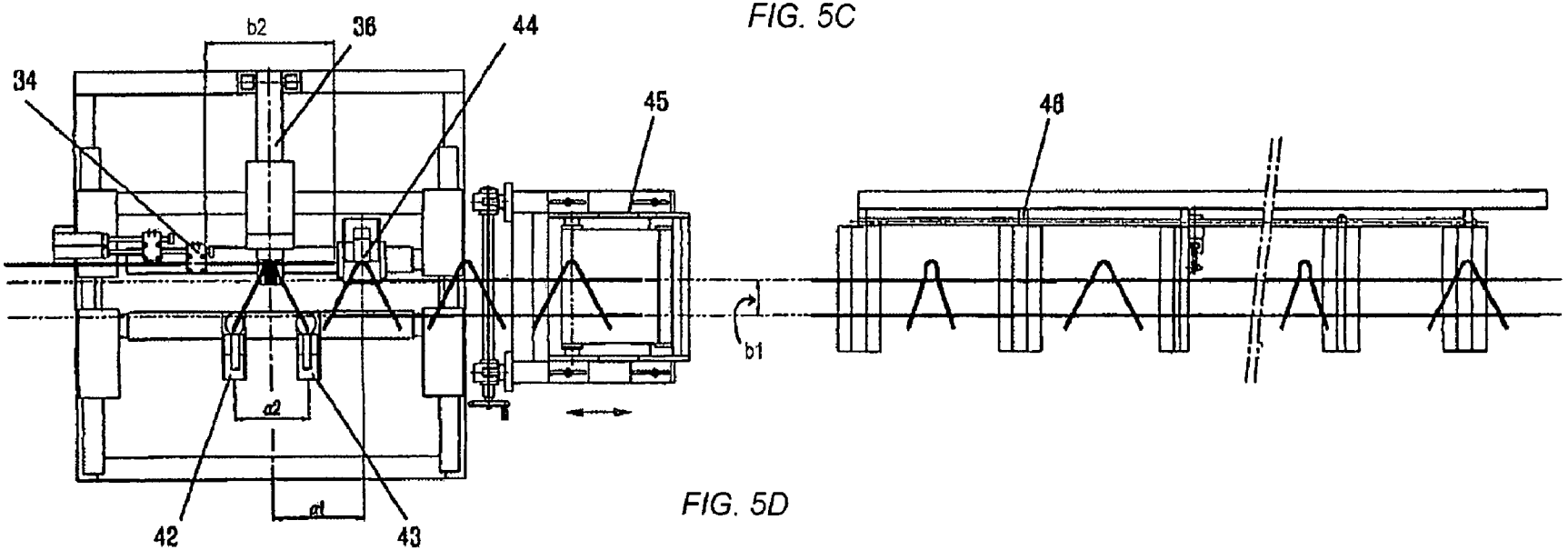
FIG. 5D continues the plan view shown in FIG. 5B.

The general layout of a machine is shown in partial views in FIGS. 5A-5D, at a top (plan) view and a side view, where FIG. 5C is a continuation of FIG. 5A, and FIG. 5D is a continuation of FIG. 5B. The machine comprises a main forming mechanism, the supply to the machine and the collection of the final product.

Following the course of the material, the machine may comprise several sybsystems.

Wires (1), (2) and (3) are uncoiled by the pay-off stations (4), (5) and (6) respectively, are straightened on the straightening units (7), (8) and (9) respectively, which on this particular implementation operate with a straightening rotor, and are guided to the wire storage units (buffers) (13), (14) and (15) respectively. The quantity of stored wire in the buffer is controlled by two terminal switches per wire, e.g. (16) and (17) for wire (1), (18) and (19) for wire (2), (20) and (21) for wire (3), where the switch (16) is activated when the buffer is full and sends a signal to the motor (10) driving the straightening unit (7) to stop feeding the buffer, whereas when the buffer is depleted, the switch (17) is activated and sends a signal to the motor (10) of the straightening unit (7), so that the motor starts to store wire in the buffer again. This operation takes place independently for each one of the three wire storage units.

Wires (1), (2) and (3) are pulled easily and with very small resistance from the buffer units, by the pairs of rollers (22) and (23), (24) and (25), (26) and (27) respectively, which are driven by the motors (28), (29) and (30) respectively, and are guided to the single-plane straightening units (31), (32) and (33) respectively, so that any small plastic deformations, acquired in the buffers may be eliminated.

At the next step, the wires are guided towards the main forming mechanism, after having converged to the proper distances for the production of each particular product. Wire (1) remains on a straight line and is not relocated for different products. As previously explained in relation to FIG. 2, convergence of the wires (2) and (3) may be facilitated by guides (51*a*), (51*b*) etc. and (52*a*), (52*b*) etc., that may be placed on a table and which guide the wires to the proper distance from the fixed longitudinal wire. The guidance length of the wires until convergence is obtained is sufficiently long, so that no plastic deformation is taking place during forced guiding of the wires.

At the next step, the wires are inserted into the main forming and welding mechanism, which is in detail presented in FIGS. 6, 7, 8, 9, 10 and 11. For the sake of the nonrestrictive example, the forming and welding subsystem may be implemented with two pairs of forming tools for forming of two different transversal shapes, as presented in FIG. 8D. The forming and welding subsystem comprises the main forming mechanism (36), which carries the forming tools (38*a*, 38*b*), (39*a*, 39*b*) and the restraining tools (37*a*, 37*b*), the welding devices (42) and (43) for welding of the formed transversal wire with the longitudinal wire (2), the welding device (44) for welding of the formed transversal wire with the longitudinal wire (3), the cutter (34) and the cutters' transfer mechanism, the mechanisms for positioning of the welding devices to the appropriate locations for production of a particular product each time, and the metal frame of the subsystem.

The location of axis YY' of the forming mechanism (FIG. 6), is fixed on the mechanism, just like the straight line defined by wire (1), hence the point on wire (1), where forming will take place is also fixed. The longitudinal wires (2) and (3) are guided at the proper distances from the wire (1), as defined from the product's geometry. The welding devices (42) and (43) are placed at the intersections of the formed transversal wire (35*b*) with the longitudinal wire (3). The welding device (44) is placed at a distance from the axis of the forming mechanism equal to a multiple of the step of the product, and on the longitudinal wire (2). Finally the cutter (34) is aligned with the wire (1) feeding, and at the appropriate distance from the axis of the forming mechanism, depending on the length and shape of the transversal wire.

The forming tools (39*a*) and (39*b*) (FIGS. 6, 7, 8) are placed on a projectile beam (36), where they are mounted with screws. The beam (36) is rotated about axis (40), with the aid of motors (81*a*) and (81*b*), which are supported through a joint (FIG. 7) on the frame of the machine and a joint (80) on the beam (36). When both motors (81*a*) and (82*b*) are activated, the forming tools may be located above the forming plane of the transversal wire, when only piston (81*b*) is activated, the forming tools (39*b*) and (38*b*) may be placed on the forming plane, and when both pistons are deactivated then the tools (39*a*) and (38*a*) may be on the forming plane.

Figure 7:
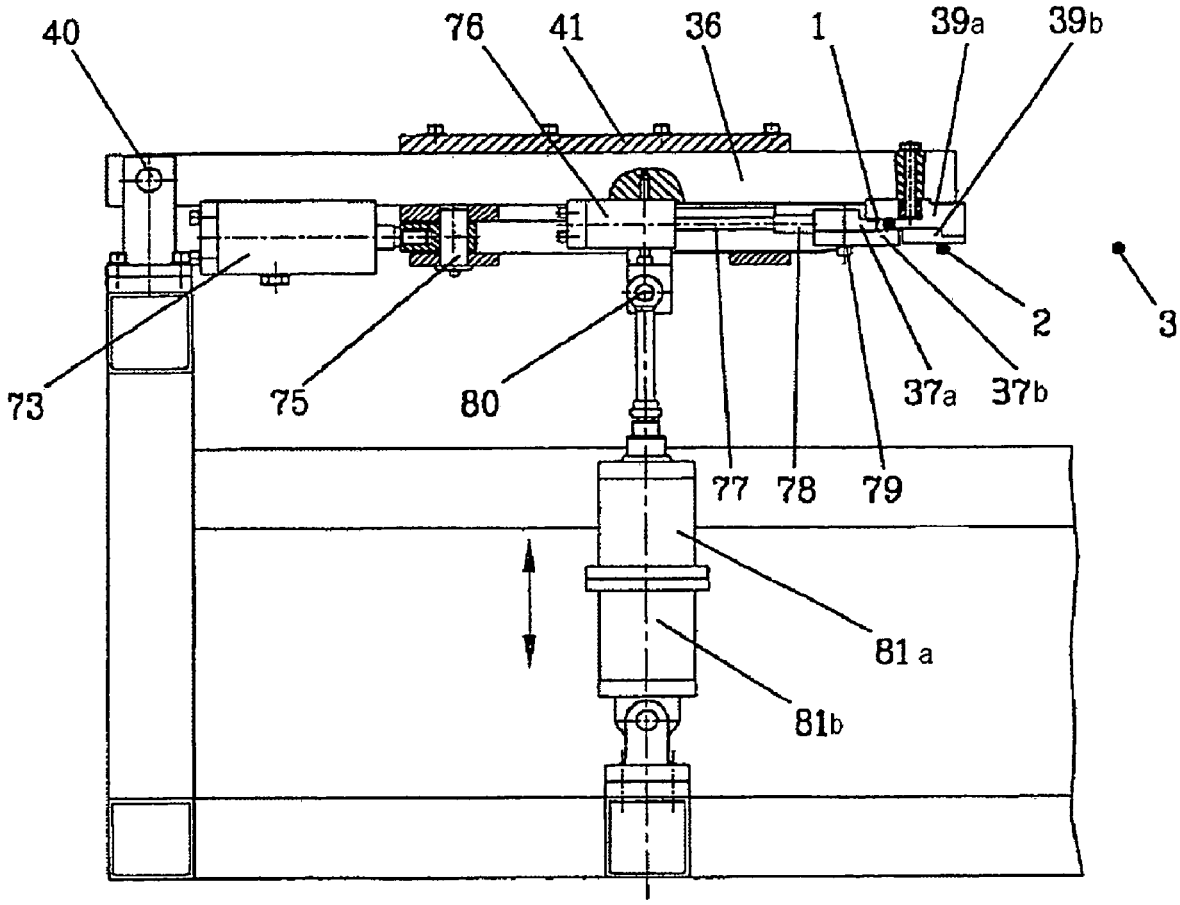
FIG. 7 is a rotated partial sectional view taken along axis YY' of FIG. 6.
Figure 8A:
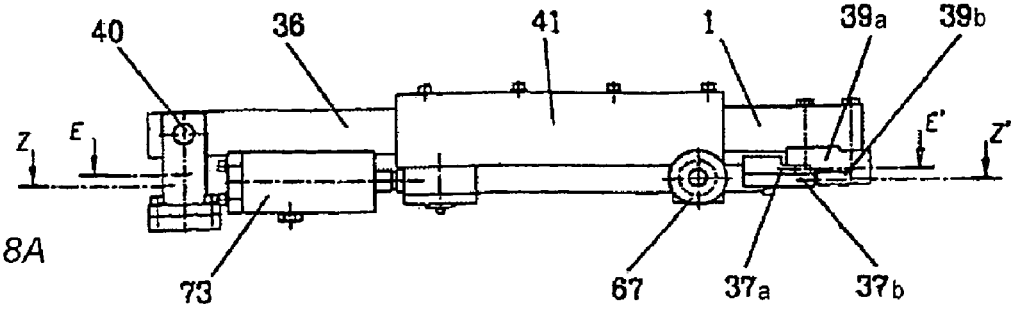
FIG. 8A is an elevational view depicting a version of the a formation assembly including plural forming tools, by which a version of the method of the invention may be effected.
Figure 8B:
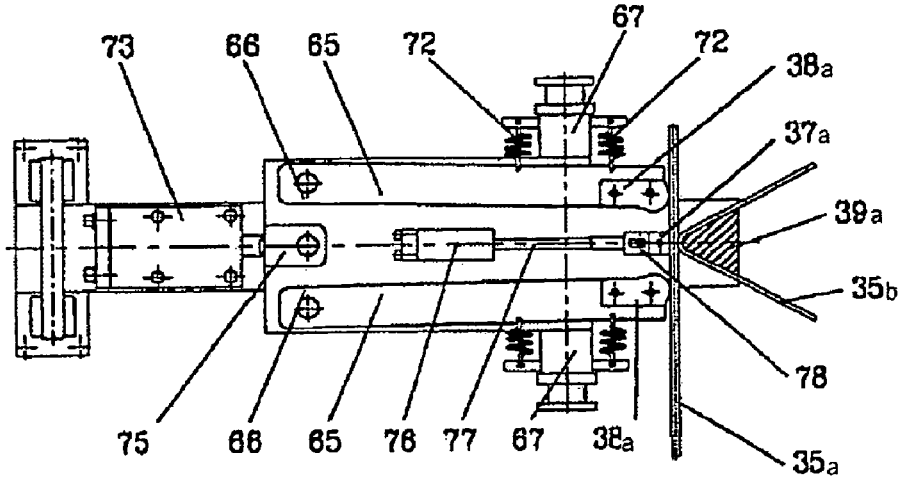
FIG. 8B is a bottom elevational view in relation to FIG. 8A and further shows a partial sectional view along axis EE' of FIG. 8A.
Figure 8C:
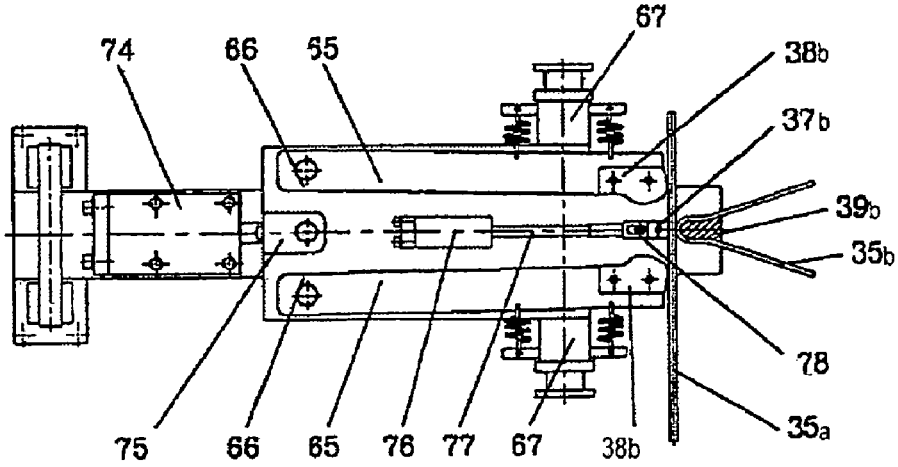
FIG. 8C is also a bottom elevation view in relation to FIG. 8A and further shows a partial sectional view along axis ZZ' of FIG. 8A.
Figure 8D:
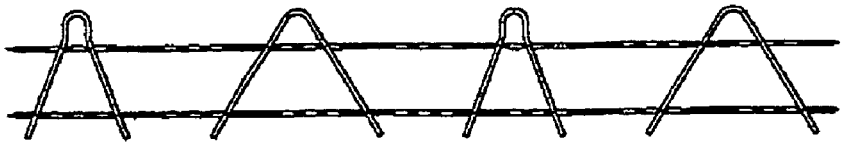
FIG. 8D schematically shows a representative product that may be produced by the invention.

The forming tools (38*a*) and (38*b*) (FIG. 8) are mounted on two metal blades (65) and are supported through two pins (66) on a moving frame (41), that can move relatively to the beam-guide (36). The moving frame (41) and consequently the forming tools (37*a*) and (37*b*) can move through the action of a hydraulic motor (73), which is supported on the beam (36) and connected to frame (41) via bolt (75) as shown in FIG. 7 and FIGS. 8B-8C. The forming tools (38*a*) and (38*b*) remain at a specific position with respect to the tools (39*a*) and (39*b*), through a mechanism (67) with disk-type springs (71) and springs (72), which will be described in detail below.

The restrainer (37*a*) and (37*b*) is mounted on a supporting base (78), which can move via piston rod (77) (FIG. 7, FIGS. 8B-8C) upon activation of the hydraulic motor (76), which is supported on the beam (36). To avoid unwanted torsional stresses, the restrainer is guided by the bolt pin (79), which is also supported on beam (36).

Figure 9B:
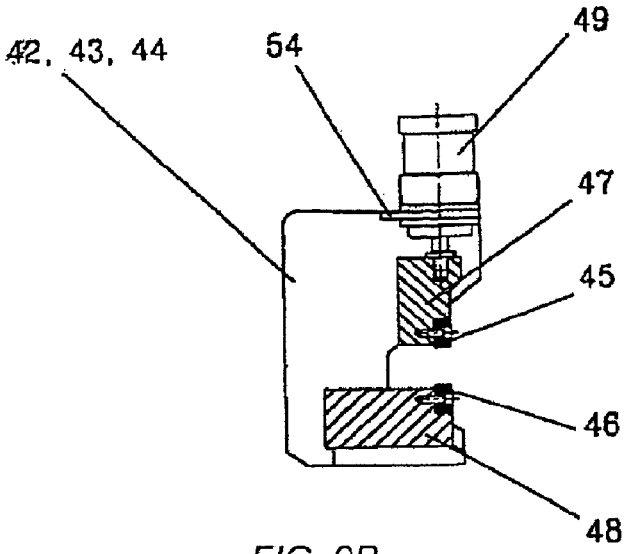
FIG. 9B further shows the welding device of FIG. 9A in partial section.
Figure 9A:
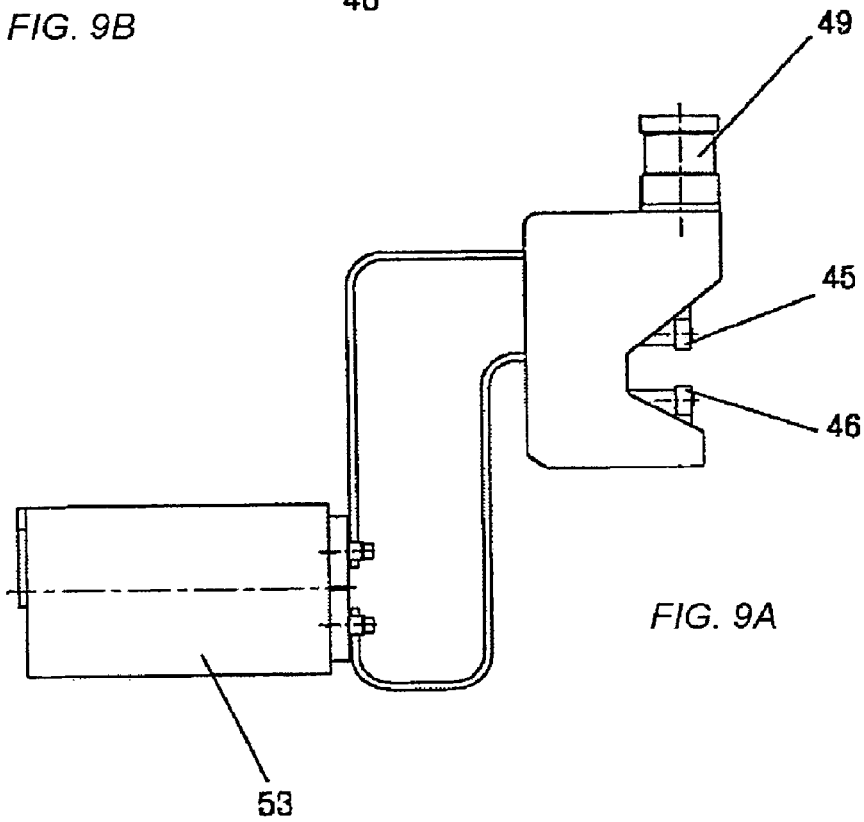
FIG. 9A is an elevational view of a welding device.

The welding devices (42), (43) and (44), as shown in FIG. 9A and FIG. 9B, are identical and consist of the welding copper electrodes (45) and (46), their respective supporting bases made of electrolytic copper (47) and (48), a pneumatic motor (49), the metal frame (54), and the insulation of the frame and the remaining devices with insulating material i.e. panite. Both electrodes are supplied with electrical current from a welding transformer (53), which is connected with flexible copper cables. The welding devices perform resistance welding, i.e. they press the wires to be welded together, transmit strong, low-voltage current, thus inducing local melting of the material and consequently welding.

Figure 10A:
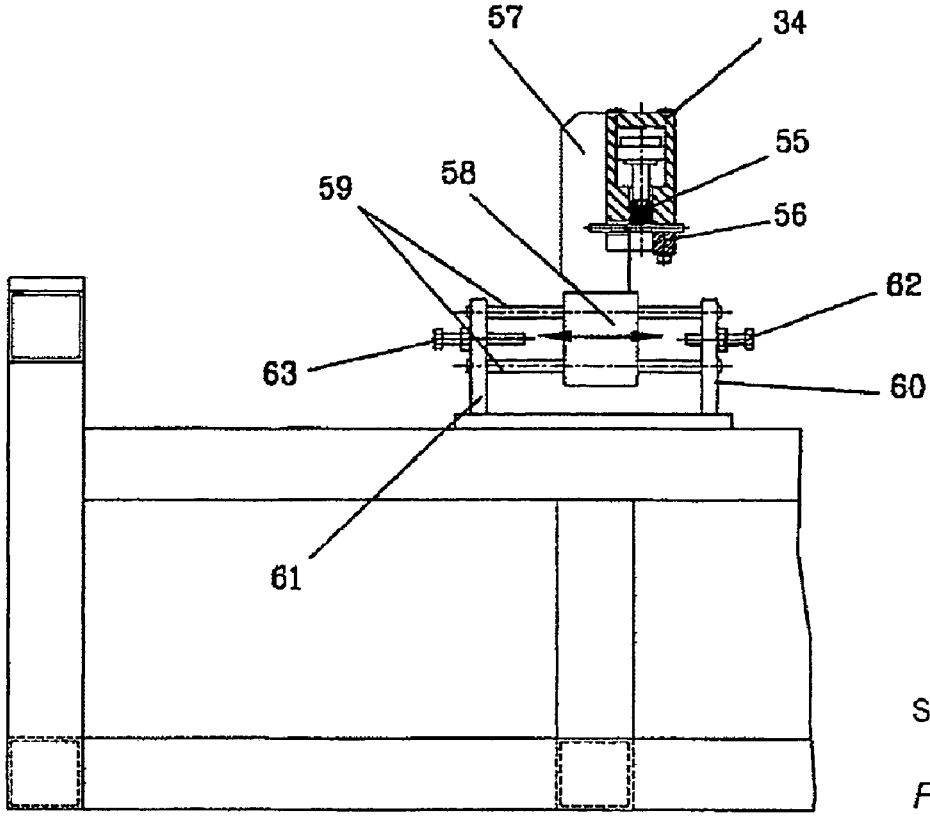
FIG. 10A shows a side elevational view of a cutter assembly.
Figure 10B:
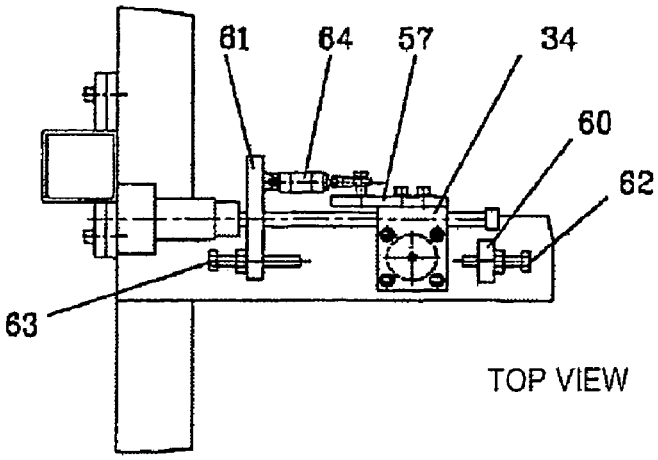
FIG. 10B shows a plan view of the cutter assembly of FIG. 10A.

As shown in FIG. 10A and FIG. 10B, the cutter (34) comprises two steel blades, one fixed (56) and one moving (55), where the moving blade may be driven by a hydraulic motor.

The cutter (34) is supported on a moving frame (58) through a blade (57). The moving frame (58) and consequently the cutter (34), can move on guides (59) via action of a pneumatic motor (64) between two positions, which are determined by two mechanically regulated stops (62) and (63). The cutter's support and transfer mechanism is mounted on the frame of the machine with the blades (60, 61).

Figure 11:
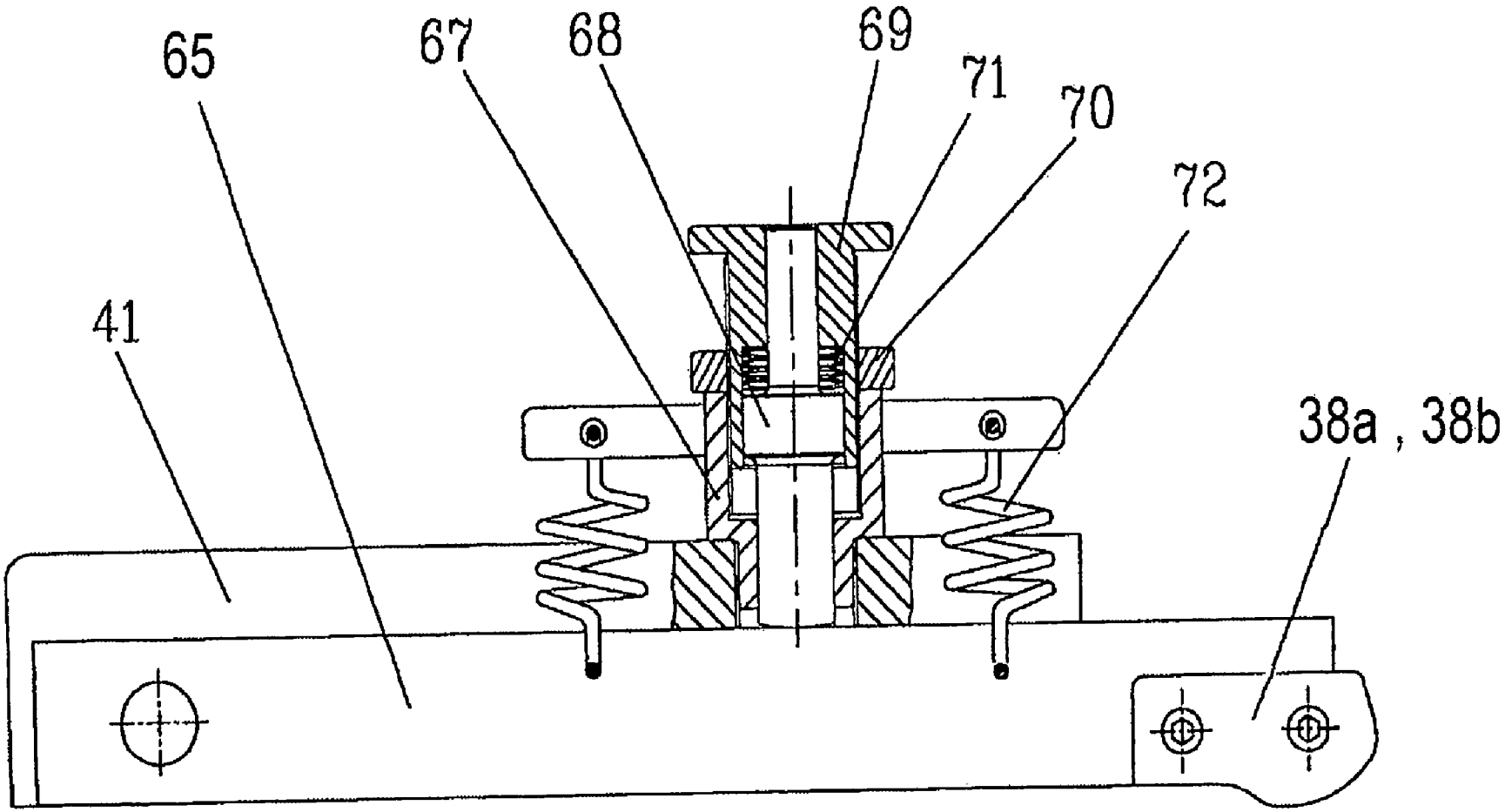
FIG. 11 details the adjustable-bias spring mechanism of the movable forming tool (38).

As shown in FIG. 11, the location of the forming tool (38*a*) and (38*b*) with respect to the forming tool (39*a*) and (39*b*) is determined by the pin (68), which is pushed by the hard disc-type springs (71) and by the beam (65) retracting springs (72). The force exerted by the pin (68) is determined by the pre-contraction of the springs (71), which is regulated by the bolt (69), and is secured by the nut (70).

Figure 6:
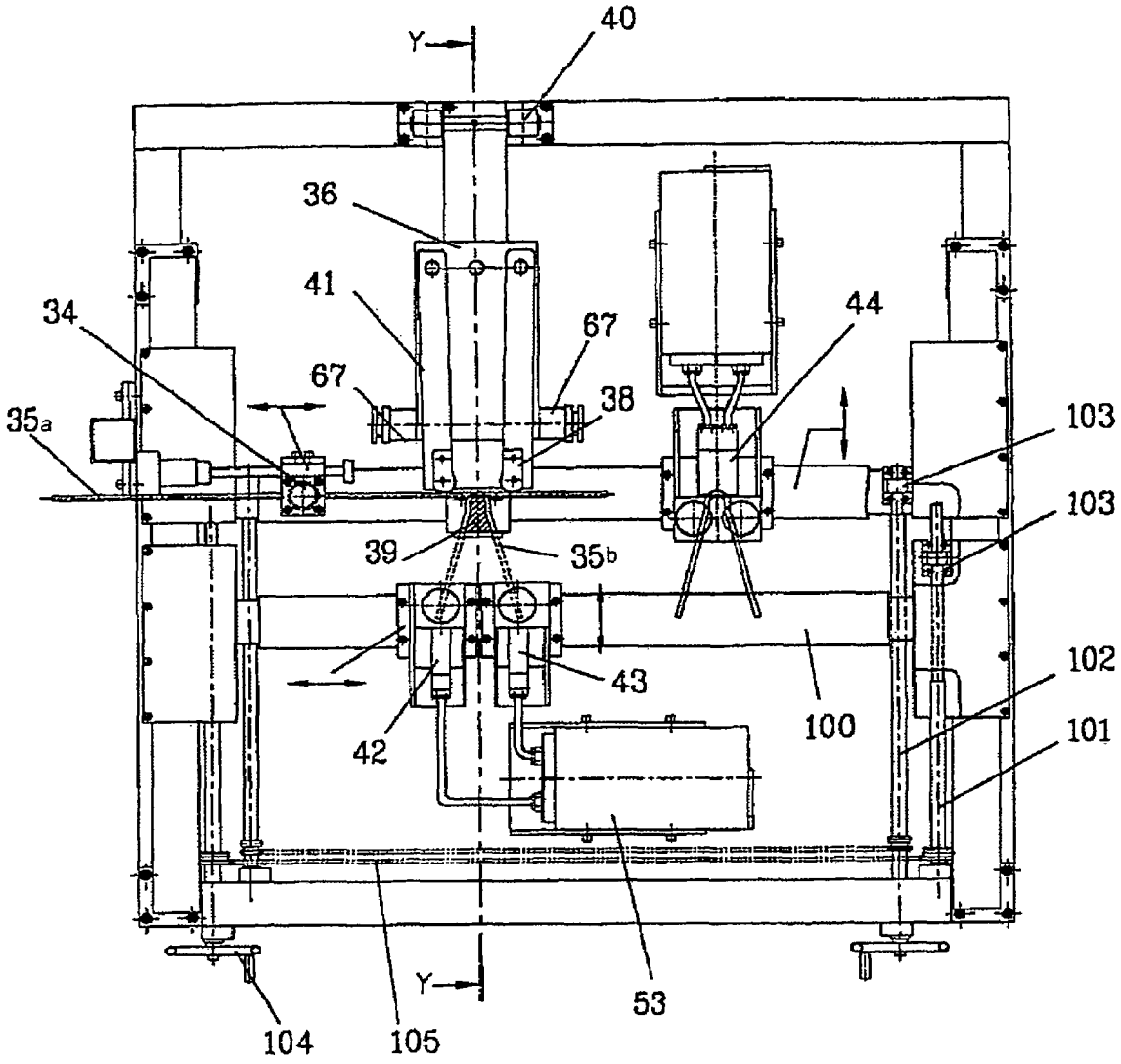
FIG. 6 shows a plan view of formation and welding assemblies.

In a version of the invention, the welding devices (42), (43) and (44) may be positioned at the appropriate locations through pin-bolts and chains. For example, the welding device (42) may be driven on beam (100) by the bolt (101), the chain (105) and the wheel (volant) (104), while the bolt (102), as shown in FIG. 6, similarly may drive welding device (44). Both bolts (101, 102) may be rotatably supported by well-known bearings as shown in FIG. 6.

The machine may operate in the following way:

Initially, the appropriate forming tools, the cutter and the welding devices are placed at the appropriate positions.

The beam (36) moves upon deactivation of pistons (81*a*) and (81*b*) and transfers the forming tools (39*a*) and (38*a*) to the horizontal level, defined by the wire (1) straight line.

The cutter (34) of wire (3) is transferred to the appropriate position upon activation of motor (64).

Wires (2) and (3) are fed according to the step of the product and wire (1) is fed according to the length of the transversal wire.

Upon activation of the hydraulic motor (73) the restrainer (37*a*) is relocated and is driven to hold wire (1) on the forming tool (39*a*).

Wire (1) is cut upon activation of the cutter's hydraulic piston (34).

Upon activation of the hydraulic motor (73), the frame (41) moves the forming mechanism and forms the wire (35*a*) to the shape (35*b*).

The ends of the formed wire are welded with the longitudinal wire (3) by the welding devices (42) and (43), while at the same time the forming tool and the restrainer press and hold the formed wire.

Another transversal wire frame, already formed during the previous operation step, is welded to the longitudinal wire (2) at the welding device (44) simultaneously with the action of the welding devices (42) and (43).

In the next step, the hydraulic motor (73) is activated reversely and the forming tool (38*a*) moves backwards.

The hydraulic motor (76) is activated reversely and the restrainer (37*a*) moves backwards.

The motors (81*a*) and (81*b*) are activated and the beam-guide (36) moves upwards, moving the tools also upwards, so that the formed transversal wire (35*b*) is completely released.

The motors moving the welding devices (42) and (43) are activated, so that the welding copper electrodes are withdrawn and the transversal wire is released.

Wires (2) and (3) are fed at one product step and at the same time they push the already formed part towards its storage unit.

Upon actuation of motor (64) the cutter (34) moves to its second location.

Upon activation of motor (81*b*) only, the forming tools (39*b*), (38*b*) and the restrainer (37*b*) are transferred into alignment with the wire (1).

The forming and welding procedure is repeated as stated above for the production of the second transversal wire frame.

When the product is manufactured at the appropriate length, it is cut off by a guillotine type cutter (45) with knives (110, 111) as shown in FIG. 5C, upon activation of the hydraulic piston (112).

The cut off product is delivered to a storage unit (46), where it is stacked.

The method is non-restrictive concerning the number of different transversal shapes. The required transversal tools may be mounted on the presented machine in a similar way as described above, and artisans in the art will understand that the lever may be driven by servomechanisms of pneumatic, hydraulic or electro-mechanic type of action.

The cutter of the transversal wire to be formed may be driven by a suitable servomechanism in order to cut the wire at any position required.

The transfer of the forming tools to the forming location may be implemented either through parallel translation, at a direction perpendicular to the beam (36), or through the beam's (36) rotation, as described earlier.

The welding devices (42), (43) and (44) may be fixed in the case where the welding electrodes are wide enough to cover different points of contact between the formed transversal with the longitudinal wires, as in an implementation of the machine which was described earlier. For production of different shapes of transversal wire frames, the welding devices may be placed on transfer frames, which position the devices at the appropriate locations along the longitudinal wires, so that welding of the formed transversal wires with the longitudinal wires can take place.

Thus, the method produces continuous or non-continuous concrete reinforcements from wire, rod, tube, or other material of prismatic cross section, where each of the three wires (1), (2), (3), is separately pulled through a drive mechanism from a pay-off station, is straightened at a respective straightening device (7), (8), (9), is fed to a respective storage unit (buffer) (13), (14), (15), and advances to the forming and welding mechanism. There the transversal frame may be formed and welded in a continuous stepwise manner, and through the action of a cutter (45), the product is cut at the proper lengths and advances towards a collection unit (46) where it is stacked. The method utilizes the parallel feeding of the plural wires to the welding and forming mechanism, where the first wire (1) is fed at a length equal to the length of the transversal wire frame (35*a*), and the other two wires (2) and (3) are fed at a length equal to the step of the product. Subsequently, the first wire is guided at the forming moulds (38) and (39) where the cutter (34) is placed in proper location in order to cut this first wire (1) at a length (35*a*) equal to the length of the transversal wire (35*b*). The other two wires (2), (3), may be kept at a fixed separation distance. The method may preferably utilize plural welding devices, including the two devices (42) and (43) located at each side of the forming tool axis YY' at points B and C, respectively, where the transversal formed wire (35*b*) intersects with the second longitudinal wire (3); and, a third welding device (44) placed on the first longitudinal wire (2) at a distance from the formation axis equal to an integer multiple of the product step. The method may include a restrainer (37) holding the wire to be formed (35*a*) firmly on a fixed mould (39) so that a cutter (34) may then cut the wire, while at the same time it is formed by the action of a moving mould (38) moving towards the fixed mould (39) to form of a transversal piece (35*b*). Notably, the location of the cutter (34) with respect to the formation axis YY' may vary, depending on the shape and the length of the transversal wire. The method may proceed to welding of the formed wire (35*b*) with the longitudinal wire (3) at the formation location while it is still being held by the restrainer (37), and by the simultaneous welding of one already prepared transversal piece with the first longitudinal wire (2) on the welding device (44). The method may proceed further to a withdrawal of the moving mould (38) away from the steady mould (39), the consequent withdrawal of the restrainer (37), the relocation of the transversal wire forming subsystem at a direction normal to the plane of the product, the advancement of the longitudinal wires (2) and (3) at a distance equal to the product step, carrying along the already manufactured product, the advancement of the wire (1) at a distance equal to the length of the transversal wire, and so on until the production process is completed.

As will be understood from the description immediately preceding, the transversal wire frames may be of different shapes which are produced by different sets of moving forming moulds (38*a*), (38*b*) etc., fixed moulds (39*a*), (39*b*) etc. and restrainers (37*a*), (37*b*) etc. mounted on different planes per each set, and being parallel to the forming plane, where each set of moving mould, fixed mould and restrainer can move perpendicularly to the forming plane, so that the appropriate, each time, set of tools is transferred on the forming plane for the forming of each transversal wire. Notably, the transversal wire may be welded with the second longitudinal wire without protruding beyond the second longitudinal wire. Also, the transversal wire may be welded with the second longitudinal wire (2) at a distance equal to an integer multiple of the product step, while at the same time a formation and welding operation takes place at the formation location.

The machine produces continuous or non-continuous concrete reinforcement from wire, tube or other material of prismatic cross section by uncoiling three wires (1), (2), (3) from their pay-off stations each one separately, via rotating straightening devices (7), (8), (9) respectively, into respective storage units (wire buffers) (13), (14), (15), and where each wire is driven via pairs of straightening rollers (22) and (23), (24) and (25), (26) and (27) through a single-plane straightening device (31), (32), (33) respectively, towards the forming and welding mechanism, where the product is formed and welded with continuity, where the product is then fed through a cutter (45), where it is cut at the appropriate lengths, and then fed to a collection unit (46), where it is stacked, where the machine effects the advancement of the wire (1) via a servomotor (28) and pairs of feeding rollers (22), (23), at a specific distance (35*a*) equal to the length of the transversal wire (35*b*), and by the advancement of the longitudinal wires (2) and (3) via the servomotors (29) and (30) and the pairs of the feeding rollers (24), (25) and (26), (27) at a distance equal to the product step, towards the welding mechanism, where at the welding mechanism, the wire (1) or (35*a*) is firmly held by the restrainer (37) on the tool (39), is cut by the cutter (34) and is simultaneously formed (35*b*) by the action of the forming tools (38), where the machine may also include the action of the welding devices (42) and (43) exactly at the intersections of the already formed transversal wires (35*b*) and the longitudinal wire (3), where the transversal wire (35*b*) is welded to the longitudinal wire (3) while it is still restrained by the forming tools (38) and (39), and by the action of a third welding device (53), located at a distance from the formation axis YY' equal to an integer multiple of the product step, where the already formed transversal wire is welded with the longitudinal wire (2), simultaneously with the forming of a new transversal wire in the forming location YY', and where the machine may also include the consequent withdrawal of the restraining and forming tools away from the formation plane, so that the already formed transversal wire (35*b*) is completely released, so that another machine operation cycle of the machine can be repeated.

Thus, the machine may be used for the production of continuous or non-continuous concrete reinforcement from wire, tube or other material or prismatic cross section where the formed transversal wires may be of various, alternating shapes which are produced by different sets of restrainers (37*a*), (37*b*) etc., moving forming tools (38*a*), (38*b*) etc. and fixed forming tools (39*a*), (39*b*) etc., where the different sets of tools are mounted on different parallel planes, which are parallel to the formation plane, and which can move in a direction perpendicular to the formation plane, so that the appropriate, each time, set of tools is transferred to the formation plane for the forming of the transversal wire. The machine may include the transversal wire formation mechanism as well as the restraining tools mounted on a projected beam (36), which is simply supported at the far end through a joint at an axis (40) and can rotate about it upon the action of a piston (81), in order to bring to the formation plane the appropriate set of tools. The machine's forming tools may be mounted on two metal blades (65), which may rotate about the pins (66) on the moving frame (41), and are pressed towards the fixed tool (39) by contracted disc-type springs (69). Furthermore, a special mechanism may move the wire cutter (34) to the proper location, in order to cut the wire (35*a*) at the proper length, equal to the length of the development of the wire (35*b*).

Several advantages of the present invention include the following:

The machine that is manufactured with the present method is extremely flexible, making any change of geometry of the produced part simple, by re-positioning the welding devices and the cutter at the proper location, and by alternating the forming tools.

Excellent quality of the final product, since welding with one of the two longitudinal wires is executed simultaneously with the formation of the transversal wire.

The machine is characterized by high production capacity, due to the simple movements, which are required, and the capability for simultaneous forming and welding.

The machine operation is simple and its construction is compact and robust.

The machine is distributed for easy attendance, access and operation.

The machine operation is fully automated and only the operator's attendance is required.

The materials and components used for the implementation of this invention, as well as their dimensions, can vary, in accordance with special requirements.

The spirit and scope of the appended claims should not be limited to the description of the preferred versions contained herein. Many modifications may be made in the techniques and structures described and illustrated herein without departing from the spirit and scope of the invention. Accordingly, the techniques and structures described and illustrated herein should be understood to be illustrative only and not limiting upon the scope of the present invention. The scope of the present invention is defined by the claims, including known equivalents and unforeseeable equivalents at the time of filing of this application.

What is claimed is:

1. A machine for producing frames comprising:

a feeding system configured to feed at least one longitudinal rod;

said feeding system configured to feed at least one transverse rod;

a transverse-rod formation mechanism configured to receive the at least one transverse rod;

said transverse-rod formation mechanism including at least one reciprocating formation tool;

said transverse-rod formation mechanism including at least one second formation tool;

said transverse rod formation mechanism including a transverse-rod restrainer;

a beam supporting said at least one reciprocating formation tool;

a motor configured to operate on said beam so as to controllably translate said beam transversely relative to a plane defined by an axis of the at least one transverse rod and by a parallel to an axis of said beam.

2. The machine for producing frames as recited in claim 1, wherein:

said at least one reciprocating formation tool is configured to reciprocate on said beam.

3. The machine for producing frames as recited in claim 1, wherein:

said at least one second formation tool is mounted on said beam.

4. The machine for producing frames as recited in claim 1, wherein:

said transverse-rod restrainer is mounted on said beam.

5. A machine for producing frames as recited in claim 1, further comprising:

a pivoting connection configured to support said beam so as to permit rotation of said beam relative to said plane.

6. A machine for producing frames as recited in claim 1, further comprising:

a welding assembly adapted to join the at least one longitudinal rod to the at least one transverse rod.

7. A machine for producing frames as recited in claim 1, further comprising:

a transverse-rod cutter configured to cut the at least one transverse rod.

8. A machine for producing frames as recited in claim 7, further comprising:

a motor configured to operate on said cutter to selectively position said cutter.

9. A machine for producing frames comprising:

a feed system configured to feed plural longitudinal rods;

said feeding system configured to feed at least one transverse rod;

a transverse-rod formation mechanism configured to receive the at least one transverse rod;

said transverse-rod formation mechanism including plural pairs of formation tools; and, a motor operatively connected to position said transverse-rod formation mechanism relative to a plane defined by at least one of the longitudinal rods and the at least one transverse rod to align a selected pair of said plural pairs of formation tools for action on the at least one transverse rod.

10. A machine for producing frames as recited in claim 9, further comprising:

at least one transverse-rod restrainer configured to cooperate with said transverse-rod formation mechanism.

11. A machine for producing frames as recited in claim 9, further comprising:

a beam configured to support said transverse-rod formation mechanism.

12. A machine for producing frames as recited in claim 11, wherein:

said motor is configured to act on said beam to position said transverse-rod formation mechanism.

13. A machine for producing frames as recited in claim 11, further comprising:

a pivoting connection configured to support said beam so as to permit rotation of said beam relative to said plane.

14. A machine for producing frames as recited in claim 11, wherein:

at least one of said formation tools is configured to reciprocate on said beam.

15. A machine for producing frames as recited in claim 9, wherein:

at least one of said formation tools is a mold.

16. A machine for producing frames as recited in claim 9, in which:

at least one of said pairs of formation tools includes a reciprocating formation tool and a static formation tool.

17. A machine for producing frames as recited in claim 9, further comprising:

a welding assembly configured to join at least one longitudinal rod to the at least one transverse rod.

18. A method for producing frames which comprises the steps of:

supplying plural longitudinal rods;

supplying at least one transverse rod;

cutting the at least one transverse rod to selected length;

translating, relative to a plane defined by at least one longitudinal rod and the cut transverse rod, a formation mechanism including plural pairs of formation tools;

selecting a pair of formation tools from the plural pairs included in the formation mechanism;

bending the cut rod with the selected pair;

restraining the bent rod; and, welding the bent transverse rod to at least one longitudinal rod.

19. A method for producing frames as recited in claim 18, further comprising the step of:

advancing to reposition both the welded transverse rod and at least one longitudinal rod.

20. A method for producing frames as recited in claim 19, further comprising the step of:

welding the repositioned bent transverse rod to at least one other longitudinal rod.

21. A machine for producing frames comprising:

a feed system configured to feed at least one longitudinal rod;

said feeding system also feeding at least one transverse rod;

a transverse-rod formation mechanism receiving said at least one transverse rod;

said transverse-rod formation mechanism including at least one reciprocating formation tool;

said transverse-rod formation mechanism including at least one second formation tool;

said transverse rod formation mechanism including a transverse-rod restrainer;

a beam configured to support said at least one reciprocating formation tool;

a movable frame reciprocatively mounted on said beam;

at least one restrainer motor supported on said beam to controllably reciprocate said transverse-rod restrainer;

a frame motor operatively connected to said movable frame to controllably reciprocate said movable frame; and, a beam motor operatively connected to said beam to controllably translate said beam transversely relative to a plane defined by an axis of the at least one transverse rod and by a parallel to an axis of said beam.

* * * * *

UNITED STATES PATENT AND TRADEMARK OFFICE

CERTIFICATE OF CORRECTION

PATENT NO. : 7,607,210 B2
APPLICATION NO. : 10/467933
DATED : October 27, 2009
INVENTOR(S) : Antonios Anagnostopoulos It is certified that error appears in the above-identified patent and that said Letters Patent is hereby corrected as shown below:

In the Claims:

Claim 9 at column 13, line 2, “feed system” should be changed to -- feeding system --

Claim 21 at column 14, line 24, “feed system” should be changed to -- feeding system --

Signed and Sealed this
Twenty-fourth Day of September, 2013

Teresa Stanek Rea
*Deputy Director of the United States Patent and Trademark Office*